US005347195A

United States Patent [19]

Seo

[11] Patent Number: 5,347,195

[45] Date of Patent: Sep. 13, 1994

[54] ELASTIC SUPPORT DEVICE FOR A SHADOW MASK OF A COLOR PICTURE TUBE

[75] Inventor: Ho S. Seo, Daeku-si, Rep. of Korea

[73] Assignee: Gold Star Co., Ltd., Seoul, Rep. of Korea

[21] Appl. No.: 852,523

[22] Filed: Mar. 17, 1992

[30] Foreign Application Priority Data

Apr. 1, 1991 [KR] Rep. of Korea ..... 4417/1991

[51] Int. Cl.[5] ..... H01J 29/07

[52] U.S. Cl. ..... 313/404; 313/406; 313/407

[58] Field of Search ..... 313/404, 405, 406, 407, 313/408, 284, 292

[56] References Cited

U.S. PATENT DOCUMENTS 4,335,329 6/1982 Fukuzawa et al. ..... 313/406

4,358,702 11/1982 Gijrath et al. ..... 313/402

4,950,943 8/1990 Ito ..... 313/404

*Primary Examiner*—Donald J. Yusko

*Assistant Examiner*—Ashok Patel

*Attorney, Agent, or Firm*—Fish & Richardson

[57] ABSTRACT

This invention relates to an elastic support device for a shadow mask of a color picture tube which is able to minimize stress of elastic members resulting from thermal expansion of the shadow mask during operation of the color picture tube. Thus, the compensation for mislanding of an electron beam emitted to a screen is improved. The device includes a first elastic member having a first end thereof fixed to the frame and coupled at a second end thereof to a panel pin, wherein the panel pin is secured to the panel, thereby exerting elastic force upon the frame and a second elastic member having a first end thereof slidably coupled with the frame and a second end thereof to the first elastic member, thereby exerting auxiliary elastic force upon the frame.

4 Claims, 2 Drawing Sheets

ELASTIC SUPPORT DEVICE FOR A SHADOW MASK OF A COLOR PICTURE TUBE

BACKGROUND OF THE INVENTION

1. Field of the Invention

This invention relates to an elastic support device for a shadow mask of a color picture tube, and more particularly an elastic support device for a shadow mask of a color picture tube, which is able to minimize stress of elastic members resulting from thermal expansion of the shadow mask during operation of the color picture tube, thereby improving compensation for mislanding of an electron beam emitted to a screen.

2. Description of Related Art

Generally, a color picture tube has, as shown if FIG. 1 of the accompanying drawings, a bulbiform exterior configuration comprising a panel 1, and a funnel 2 formed with a neck portion 2*a* having a reduced cross-section. An electron gun 3 is mounted within the neck portion 2*a* of the color picture tube to emit an electron beam 4, and a shadow mask 6 formed with small through-holes each having a diameter of the order of 0.3 mm is disposed within the enlarged portion of the funnel 2 opposite the neck portion 2*a* in spaced-apart relationship to the inner surface of the panel 1 so that the electron beam 4 emitted from the electron gun 3 passes through respective through-holes of the shadow mask.

In addition, a screen 5 having luminous fluroescent materials for red, green and blue colors coated thereon in a given pattern is attached to the inner surface of the panel 1 in parallel, spaced-apart relationship to the shadow mask 6, whereby the electron beam passed through the shadow mask lands on the luminous fluorescent materials coated on the screen to cause luminescence of the fluroescent materials coated on the screen, thereby forming a picture image on the screen. At this time, the interior of the color picture tube is maintained in a high vacuum state (of approximately 10 Torr) in order to enable the electron beam 4 to be accelerated and effectively land on the screen 5 coated with the luminous fluorescent materials.

With the color picture tube thus constructed, about 20% of the electron beam 4 emitted from the electron gun 3 mounted within the neck portion 2*a* passes through the small through-holes of the shadow mask 6, while the remaining 80% of the beam collides against the shadow mask, resulting in thermal expansion of the shadow mask made of a thin sheet having thickness of appoximately 0.2 mm. Such thermal expansion of the shadow mask due to the collisin of the electrom beam causes variation of the relative positions between the through-holes of the shadow mask 6 and the fluorescent materials for red, green, and blue colors coated on the screen 5, thereby giving rise to a scanning error and thus lowering color purity of the color picture tube. In order to eliminate such a phenomenon, therefore, elastic members(referred to as "corner springs") are disposed at a frame supporting the shadow mask, so that correction of the position variation as set forth above may be accomplished.

A prior art elastic member performing the function as described above is of the type shown in FIG. 2. The elastic member 8 is attached at one end thereof to the frame 7 supporting the shadow mask 6 and coupled at another end thereof to a panel pin 10 provided on the inner surface of the horizontally extending peripherey portion of the panel 1, so that it exerts elastic force upon the frame and cooperates with the frame to elastically support the shadow mask which is secured to the panel by means of the frame and the elastic member.

In this prior art, when heat is transmitted to the shadow mask 6 during operation of the color picture tube, the frame 7 supporting the shadow mask deforms due to thermal expansion of the shadow mask to exert compressive force upon the elastic member 8 secured to the lower portion of the frame.

As a result, the elastic member undergoes stress caused by the compressive force and is shifted along with the shadow mask and the frame from the position as indicated by the solid line in FIG. 2 to the position indicated by the dotted lines. At this time, if the relative positions between the mask and the frame deviate from the given allowable limits necessary for the design of the color picture tube, color purity of the picture tube is greatly lowered. Therefore, it is desired to meet the requirements that the relative positions must be maintained within the given allowable limits.

This prior elastic member is however disadvantageous in that when the member is thick so as to meet the requirements as set forth above, good elastic supportability may be obtained, but a spring-back phenomenon takes place during the forming operation, thereby making it difficult to carry out the forming operation, and to the contrary, when the elastic member is thin, the forming operation may be easily carried out, but the desired elastic supportability is not obtained.

SUMMARY OF THE INVENTION

With the foregoing drawbacks of the prior art elastic member in view, it is an object of the present invention to provide an elastic support device for a shadow mask of a color picture tube, which is able to minimize stress of elastic members resulting from thermal expansion of the shadow mask during operation of the color picture tube, thereby improving compensation for mislanding of an electron beam emitted to a screen.

To achieve the above object, there is provided according to one form of the present invention an elastic support device for a shadow mask of a color picture tube, which cooperates with a frame to elastically support the shadow mask on a panel, the device comprising a first elastic member fixed at one end thereof to the frame and coupled at another end thereof to a panel pin secured to the panel, thereby exerting elastic force upon the frame; and a second elastic member disposed at one end thereof in slidable contact with the frame and fixed at another end thereof to the first elastic member, thereby exerting auxiliary elastic force upon the frame.

DESCRIPTION OF THE PREFERRED EMBODIMENT

Figure 1:
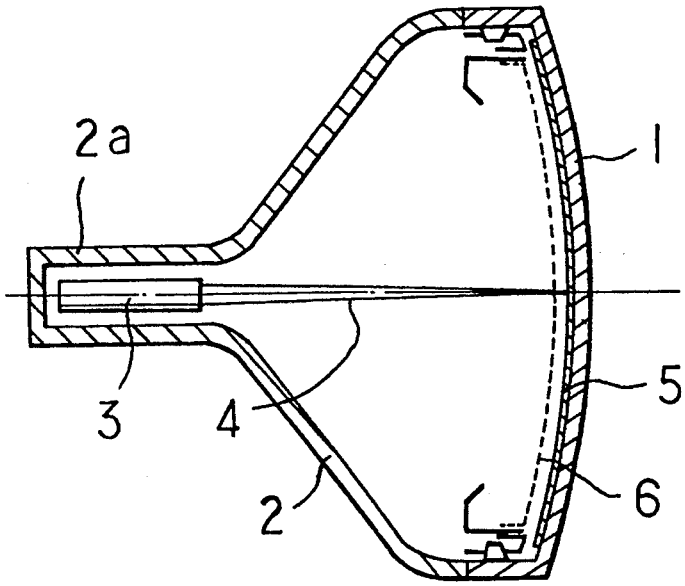
FIG. 1 PRIOR ART
FIG. 1 is a diagramatic cross-sectional view of a common color picture tube.
Figure 2:
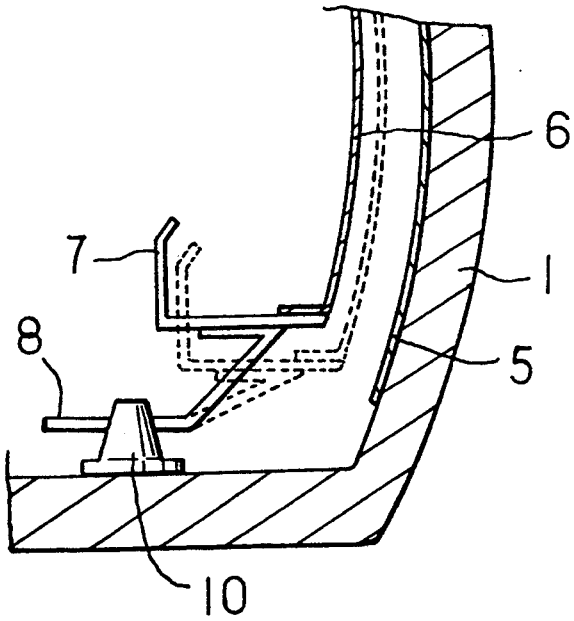
FIG. 2 PRIOR ART
FIG. 2 is an enlarged cross-sectional view showing an elastic member for a shadow mask of the color picture tube shown in FIG. 1.
Figure 3:
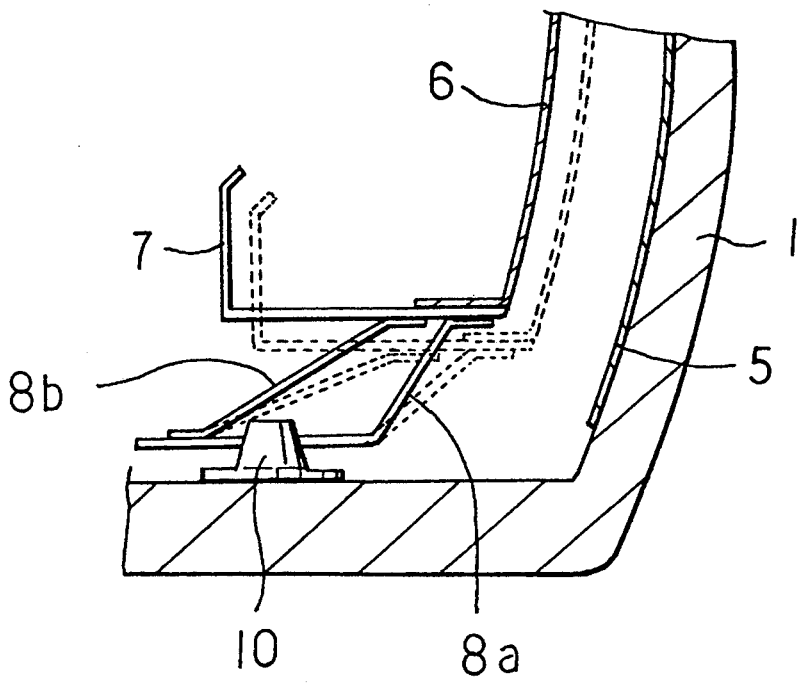
FIG. 3 is an enlarged cross-sectional view showing an elastic support device for a shadow mask of a color picture tube, according to one embodiment of the present invention.

Referring to FIG. 3 showing an elastic support device for a shadow mask of a color picture tube according to one embodiment of the present invention, the elastic support device which cooperates with a frame 7 to elastically support the shadow mask 6 on a panel 1, comprises a first elastic member 8*a* fixed at one end thereof to the frame 7 and coupled at another end thereof to a panel pin 10 secured to the panel 1, thereby acting to exert elastic force upon the frame, and a second elastic member 8*b* disposed at one end thereof in slidable contact with the lower surface of the frame and fixed at another end thereof to the first elastic member, thereby acting to exert auxiliary elastic force upon the frame 7.

Here, the end of the second elastic member 8*b* held in slidable contact with the frame is smoothly finished to reduce friction resistance during its sliding movement on the frame 7, and the opposite end thereof is fixedly secured to the end portion of the first elastic member 8*a* located on the back side of the panel pin 10, so that the frame is elastically supported by the first and second elastic members on the both sides of the panel pin. In this instance, preferably, the first elastic member 8*a* is thin in order to reduce a stress concentration on the joint thereof secured to the frame 7, and made of material having good elasticity, more preferably stainless seel. The second elastic member 8*b* is preferably made in the form of a thin leaf spring of good elastic material such as stainless steel (SUS631) to increase the auxiliary elastic force exerted upon the frame 7.

In operation of the support device thus constructed, when heat is transmitted to the shadow mask 6 during operation of the color picture tube, as shown in FIG. 3, the frame 7 supporting the shadow mask deforms due to thermal expansion of the mask, thereby exerting compressive force upon the first elastic member 8*a* fixedly secured to the lower surface of the frame, as a result of which stress is concentrated on the joint of the first elastic member attached to the frame 7. At this time, as the first elastic member undergoes the compressive force slowly applied by the frame 7, the second elastic member 8*b* is pivotally moved about its one end fixed to the first elastic member 8*a*, while sliding at its another end being in slidable contact with the lower surface of the frame. Therefore, the shadow mask 6, the frame 7, and the first and second elastic members 8*a*, 8*b* are shifted toward the screen 5 from the position as indicated by the solid line in FIG. 3 to the position indicated by the dotted lines.

At this time, the second elastic member 8*b* functions to increase the elastic supportability of the thin first elastic member 8*a* and reduce the stress concentration on the joint between the frame and the first elastic member as the frame is displaced toward the screen 5 due to the thermal expansion of the shadow mask 6. Therefore, the shadow mask can be moved uniformly toward the screen without undue deformation of the first elastic member. In addition, since the shadow mask 6 may be elastically supported with the relative positions between the luminous fluorescent materials coated on the screen 5 and the small through-holes of the shadow mask 6 maintained within the given allowable limits, a lowering of color purity of the color picture tube may be prevented.

Figure 4:
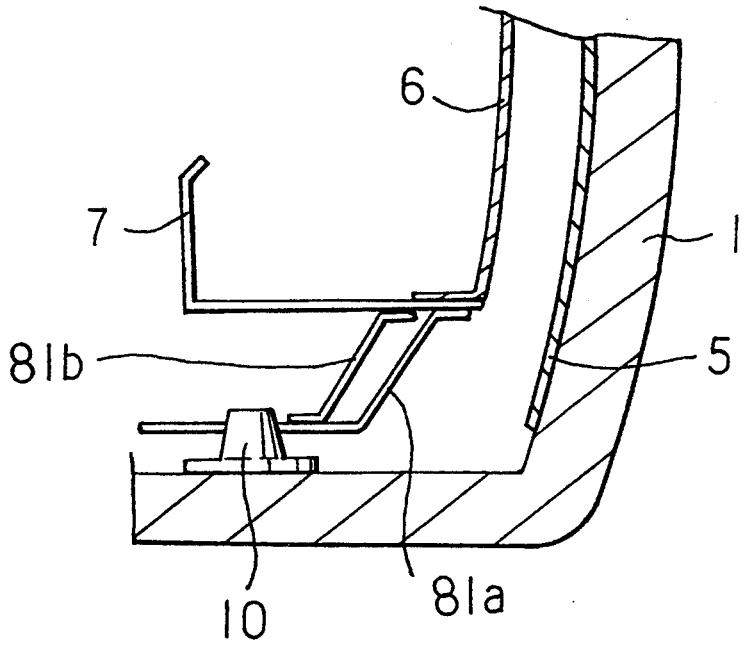
FIG. 4 is an enlarged cross-sectional view showing an elastic support device for a shadow mask of a color picture tube, according to another embodiment of the present invention.

Referring to FIG. 4 showing another embodiment of the present invention, the elastic support device according to this embodiment is identical in general construction and operation with that of the preceding embodiment in that it comprises a first elastic member 81*a* fixed at one end thereof to the frame 7 and coupled at another end thereof to the panel pin 10, thereby acting to exert the elastic force upon the frame and cooperating with the frame to elastically support the shadow mask 6 on the panel 1, and a second elastic member 81*b* disposed at one end thereof in slidable contact with the frame 7 and fixed at another end thereof to the first elastic member 81*a*, thereby acting to exert the auxiliary elastic force upon the frame. However, according to this embodiment, the position at which one end of the second elastic member is fixed to the first elastic member is differently from that in the first embodiment. More specifically, differently from the first embodiment, the second elastic member 81*b* exerting the auxiliary elastic force upon the frame 7 is fixedly secured to the portion of the first elastic member 81*a* located on the front side of the panel pin 10.

As can be seen from the foregoing, the present invention provides advantages over the prior art in that the first and second elastic members are thin, which results in excellent formability, and the separate second elastic member disposed in addition to the thin first elastic member compensates for reduction of the elastic supportability of such a first elastic member, whereby the excellent elastic support for the frame and hence the shadow mask can be provided. Furtheremore, the device according to the present invention minimizes the stress of the elastic members resulting from the compressive force applied by the frame during the operation of the color picture tube, whereby the relative positions between the through-holes of the shadow mask and the fluorescent materials of the screen can be maintained within the given allowable limits, resulting in enhanced compensation for the mislanding of the electron beam emitted to the screen.

While the invention has been shown and described with particular reference to preferred embodiments thereof, it will be understood that variations and modifications may be made therein without departing from the spirit and scope of the invention as defined in appended claims.

What is claimed is

1. An elastic support device for a shadow mask of a color picture tube, which cooperates with a frame to elastically support said shadow mask on a panel, said device comprising:

a first elastic member having a first end fixed to said frame and a second end coupled to a panel pin, wherein said panel pin is secured to said panel, thereby exerting elastic force upon said frame, said panel pin having a front side and a back side; and a second elastic member having a first end slidably coupled with said frame and a second end fixed to said first elastic member, thereby exerting auxiliary elastic force upon said frame, wherein said second end of said second elastic member which is fixed to said first elastic member is located on said back side of said panel pin.

2. An elastic support device for a shadow mask of a color picture tube as claimed in claim 1, wherein said first and second elastic members are made of stainless steel.

3. An elastic support device for a shadow mask of a color picture tube, which cooperates with a frame to elastically support said shadow mask on a panel, said device comprising:

a first elastic member having a first end fixed to said frame and a second end coupled to a panel pin, wherein said panel pin is secured to said panel, thereby exerting elastic force upon said frame, said panel pin having a front side and a back side; and a second elastic member having a first end slidably coupled with said frame and a second end fixed to said first elastic member, thereby exerting auxiliary elastic force upon said frame, wherein said second end of said second elastic member which is fixed to said first elastic member is fixedly secured to a portion of said first elastic member which is located on said front side of said panel pin.

4. An elastic support device for a shadow mask of a color picture tube as claimed in claim 3, wherein said first and second elastic members are made of stainless steel.

* * * * *